United States Patent [19]

Cross et al.

[11] 4,099,464

[45] Jul. 11, 1978

[54] SHAPED EXPLOSIVE CHARGE CASING

[75] Inventors: Graham Westwood Cross, Saltcoats; Thomas James Reid, Ardrossan, both of Scotland

[73] Assignee: Imperial Chemical Industries Limited, London, England

[21] Appl. No.: 759,556

[22] Filed: Jan. 14, 1977

[30] Foreign Application Priority Data

Mar. 1, 1976 [GB] United Kingdom ..... 8065/76

[51] Int. Cl.[2] ..... F42B 3/08

[52] U.S. Cl. ..... 102/24 HC

[58] Field of Search ..... 102/24 R, 24 HC, 28 R, 102/28 M

[56] References Cited

U.S. PATENT DOCUMENTS

| | | | |
|---|---|---|---|
| 3,279,372 | 10/1966 | Patterson | 102/28 M |
| 3,322,066 | 5/1967 | Griffith et al. | 102/24 R |
| 3,356,024 | 12/1967 | Driscoll et al. | 102/28 R |
| 3,596,598 | 8/1971 | Prior et al. | 102/28 M |
| 3,777,663 | 12/1973 | Brown | 102/24 HC |

*Primary Examiner*—Verlin R. Pendegrass

*Attorney, Agent, or Firm*—Cushman, Darby & Cushman

[57] ABSTRACT

A casing for a shaped explosive charge wherein an explosives container, a metal cavity liner and a stand-off element are joined together at their peripheral margins. The joint may be a metallurgical joint but may also advantageously be a water-destructible joint, for example, a bolted flanged joint comprising a sea-water-destructible packing element.

13 Claims, 7 Drawing Figures

FIG. 5.
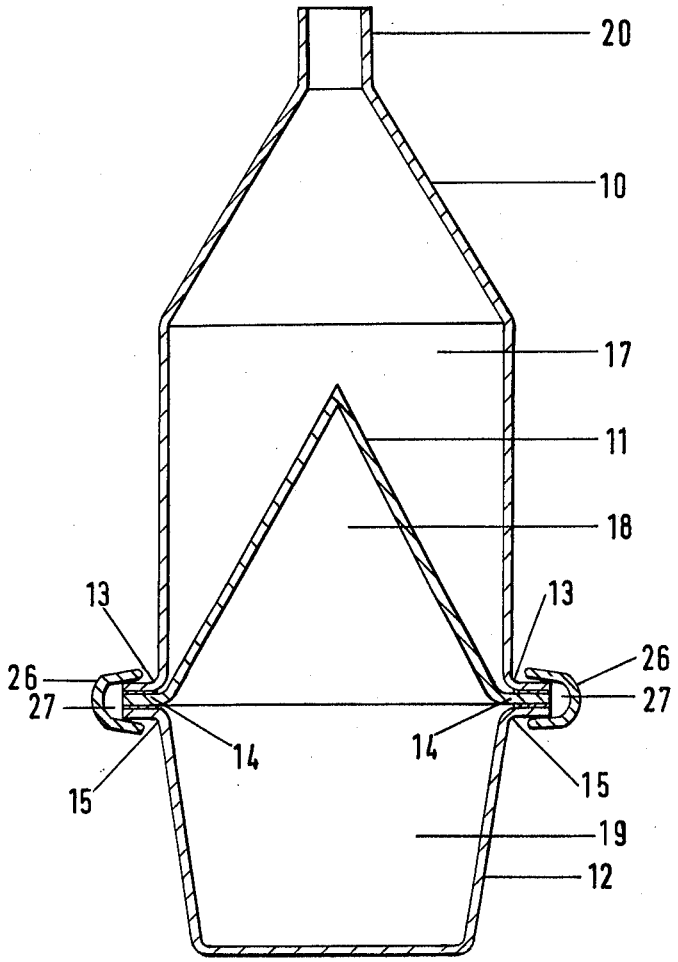
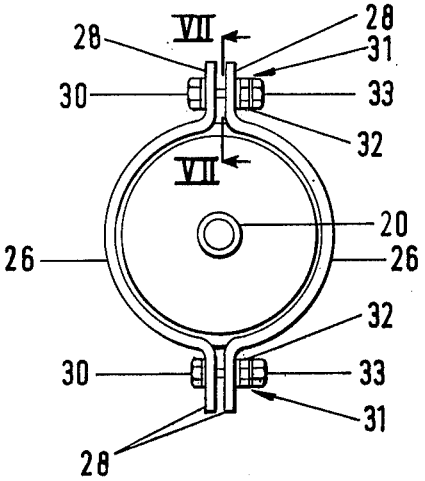
FIG. 6.
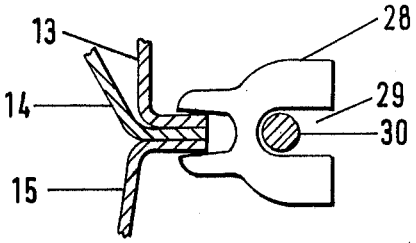
FIG. 7.

SHAPED EXPLOSIVE CHARGE CASING

This invention relates to improved casings for shaped explosive charge devices suitable for use underwater and to methods of fabricating casings for shaped explosive charge devices.

Shaped explosive charges are designed to produce a focussed shockwave of great penetrating power directed outwardly along the central axis of an outwardly divergent cavity in one face of the charge. The cavity is usually conical, frusto-conical or sphero-conical. The cavity cross-section parallel to the base may be circular but, in elongated shaped charges used for linear and curvilinear cutters it will be rectangular or other elongate form. The explosive composition is usually disposed symmetrically with respect to the cavity axis. In use the shaped charge is placed with the base of the cavity facing towards the target surface and at an optimum distance for maximum cutting effect. Usually the cavity is lined with metal to enhance the penetrating power.

The housing of the shaped charge device generally extends beyond the base of the cavity of the explosive charge to provide the required stand-off and for underwater charges the cavity and stand-off volume are sealed to exclude water. Thus underwater shaped charge devices generally have a sealed charge casing divided into an explosive charge compartment and a stand-off compartment separated by a cavity liner presenting a concave surface within the stand-off compartment.

For blasting and demolition work on the sea-bed the shaped charge casings are usually fabricated from several parts of heavy gauge steel sheets appropriately formed to shape and welded or securely clamped at side seams, corners and joints. The method of construction provides a durable explosives container which, in the event of the container being lost in the sea, could drift for years with its explosives contents intact and therefore constitute a hazard to shipping and personnel. With the increasing use of shaped explosive charges for blasting in deep water this hazard is correspondingly increased and a charge which would become safe after a reasonably short period of exposure to sea water and yet remain reliably intact during the period required for its normal use would be highly advantageous.

Thus it is an object of this invention to provide casings for shaped explosive charges which will be disintegrated on prolonged exposure to sea water.

In accordance with this invention a casing for a sea-water-destructible shaped explosive charge comprises an explosives container element, a metal cavity liner element adapted with the explosives container element to define a chamber for a shaped explosive charge and a stand-off element adapted to define a stand-off volume for the shaped explosive charge, all three elements being bound together by a joint formed at the peripheral margin of each element, which joint comprises material which is destroyed by exposure to sea water whereby, on prolonged exposure of the casing to sea water, the said material is destroyed and the explosive contents of the shaped explosive charge are subsequently exposed to the sea water and rendered harmless.

Suitable sea-water-destructible material may comprise, for example, water-soluble polymeric material such as polyvinyl alcohol or cellulose ethers, for example, methyl cellulose which may conveniently be used in a packing element of a clamped joint, for example, as a gasket or washer. A further suitable sea-water-destructible material comprises a binary metal system consisting of two complementary metals capable of electrolytic corrosion on exposure to sea water. Suitable binary systems include magnesium/iron, zinc/iron, and tin/antimony systems. The binary metal system may, for example, be incorporated in a fused metal joint or in the packing of a clamped joint. Both metals of the binary system may be included in a fusible alloy used as bonding medium in the fused metal joint or in a joint packing element but it is also convenient for the fusible alloy or the packing element to provide a complementary metal for the metal used in the fabrication of the shaped charge casing. Thus especially effective complementary metals for steel are magnesium and zinc which are conveniently used either as fusible alloys or as clamped joint packing elements.

All three elements of the casings may be metal, for example, mild steel and such elements may advantageously be fabricated from a single metal blank by a cold extrusion or drawing process. The container and stand-off elements may alternatively be fabricated from non-metallic material, for example, plastics material.

In one convenient construction the three elements are formed with external flanges at their jointed margins, and the flanges are joined together. Conveniently when all three flanges are metal the flanges are joined by a fused metallurgical joint, for example, by welding, brazing or soldering of metal flanges. Preferably in this form the flanges are co-extensive and joined by a fused metal joint around the flange edges.

Alternatively, either metal or non-metal flanges may be clamped together by clamp means such as, for example, bolts or rivets extending through the flanges, or an internally grooved compressed ring element engaging and compressing together the peripheral edges of the flanges within the groove. In this form of the invention the clamping pressure is advantageously applied by a clamp member adapted to separate from the shaped charge casing when the clamping pressure is relieved by the destruction of the sea-water-destructible material. Thus, a preferred clamp member comprises a bolt located in an open slot from which it is readily dislodged by sea water surges when the clamping pressure is relieved.

The invention also includes a method of fabricating a casing for a shaped explosive charge, in which method an explosives container element, a metal cavity liner defining with the said container element a chamber for a shaped explosive charge and a stand-off element defining a stand-off volume for the shaped explosive charge are positioned with their margins coincident, and the margins are joined together to seal said explosive chamber and said stand-off volume by means of a joint which comprises a material which is destroyed by exposure to sea water whereby, on prolonged exposure of the casing to sea water, the said material is destroyed and the explosive contents of the shaped explosive charge are subsequently exposed to the sea water and rendered harmless.

In one convenient method the elements are all metal each having an external peripheral flange around its margin and the flanges are jointed together. The joint may, for example, be a fused metallurgical joint incorporating a sea-water-destructible binary metal system preferably formed at the peripheral edge of the flanges, or the flanges may be secured by clamping together using one or more sea-water-destructible pressure transmitting packing elements which may, for example, be water soluble material or a constituent of a binary metal system located as a gasket between the flanges or as a washer on a clamping bolt.

The invention is further illustrated by the embodiments which are hereinafter described, by way of example, with reference to the accompanying drawings wherein FIG. 1 shows diagrammatically a vertical cross-section of one casing of the invention wherein the elements are joined by a fused metal joint comprising a binary metal system.

FIG. 5 shows diagrammatically a vertical cross-section of a further casing wherein the elements are joined by a sea-water-destructible clamped joint.

FIG. 6 is a plan view on a smaller scale of the casing of FIG. 5.

FIG. 7 is a section on the line VII—VII of FIG. 6 on a larger scale.

In the drawings like parts are designated by the same numeral. The casings shown in the drawings may have any convenient horizontal cross-sectional shape such as circular or oblong and may be used as appropriate for circular, linear or curvilinear shaped charges.

Figure 1:
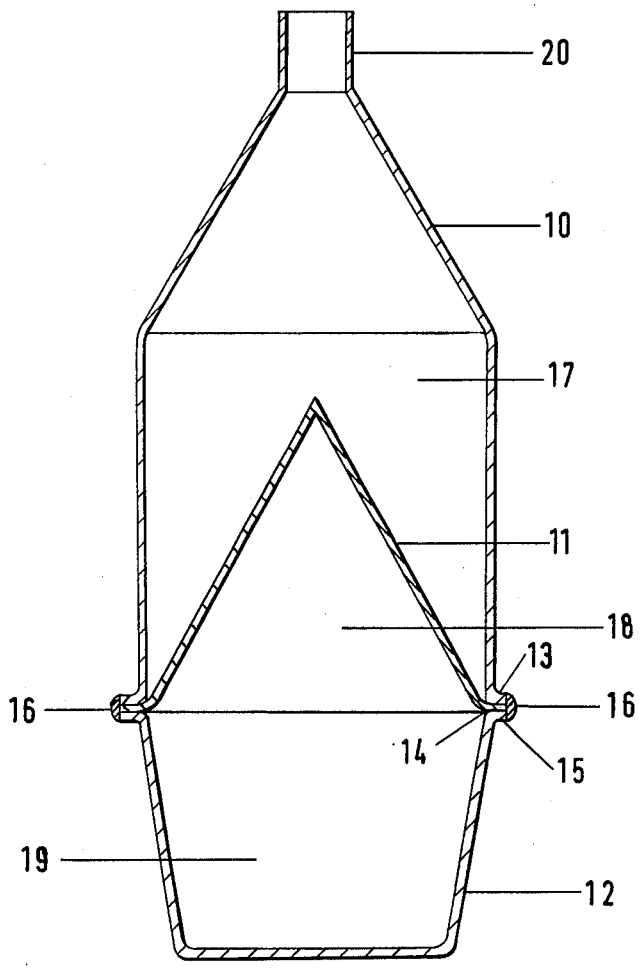

The casing of FIG. 1 comprises an explosives container element 10, a conical cavity liner element 11 and a stand-off element 12, each formed by cold extrusion from mild steel sheet. These elements are formed with marginal flanges designated respectively 13, 14 and 15. The flanges have co-extensive peripheral dimensions and coincident flanges so that when assembled as shown in FIG. 1 the peripheral edges of the flanges are coincident. The flanges are bonded together by a single continuous peripheral joint 16 comprising sea-water-destructible fusible alloy. There is thus provided on the assembled casing a sealed shaped explosive chamber 17 defined by the container element 10 and the liner element 11, a shaped charge cavity 18 within the liner element 11 and a stand-off chamber 19 within the element 12, the cavity 18 and chamber 19 being formed as a continuous sealed volume defined by the elements 11 and 12.

The container element 10 is formed with a cylindrical filler neck 20 through which a liquid explosive may be readily filled into the chamber 17 when the device is required for use. Especially convenient explosive charges for the device are two-component liquid explosives made by mixing two safe liquid components or a liquid and a solid component to form a liquid explosive. The mixing operation may be carried out at the blasting site and the explosive filled into the casing just prior to submerging the device to the use position. Suitable two-component explosives are those based on a nitroparaffin, for example, nitromethane sensitised with an amine, for example, ethylenediamine or benzylamine. After filling with explosive composition the neck 20 is closed by a stopper and the explosive is primed for firing with a loop of detonating cord led through the stopper into the composition.

Suitable solder compositions for the joint 16 include a brazing solder containing 60% w/w of copper and 40% w/w of zinc, a silver solder containing 43% w/w of silver, 37% w/w of copper and 20% w/w of zinc or a low setting solder comprising 95% w/w of tin and 5% w/w of antimony.

In the modified casing shown in FIGS. 2–7 the flanges are clamped together by fixings comprising a sea-water-destructible packing element which on its destruction relieves the clamping pressure on the joint thereby allowing the casing to disintegrate so that the explosive charge is dispersed in the water.

Figure 2:
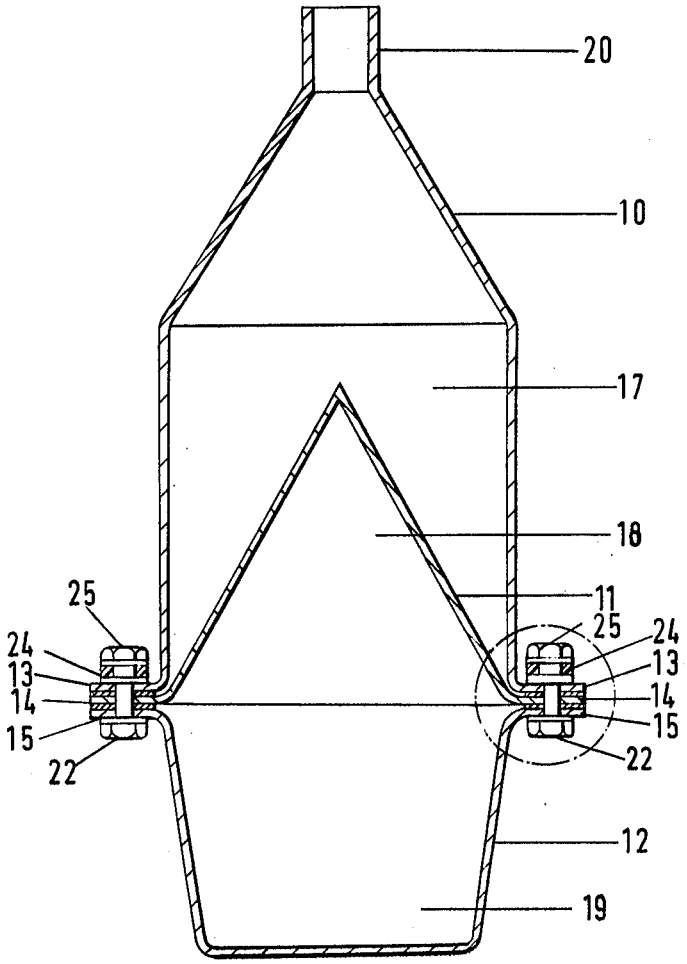
FIG. 2 shows diagrammatically a vertical cross-section of casing wherein the elements are joined by a clamped joint having a sea-water-destructible packing element.
Figure 3:
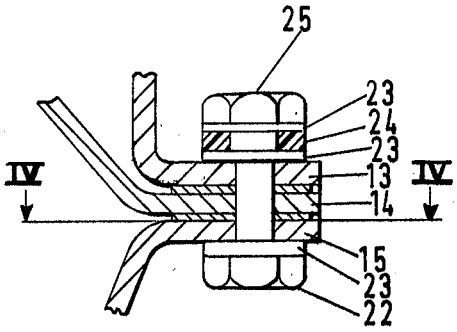
FIG. 3 shows a fragment of the casing of FIG. 2 on a larger scale.
Figure 4:
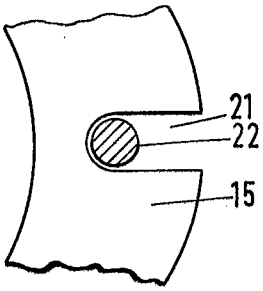
FIG. 4 shows a section on the line IV—IV of FIG. 3.

Referring to FIGS. 2–4, the flanges 13, 14 and 15 are formed with circumferentially spaced open slots 21 and are bolted together by bolts 22 extending through the slots. The bolts carry steel washers 23, sea-water-destructible washers 24 and tightening nuts 25. Sealing compound or gasketting material is interposed between the flanges. The washers 24 may be electrolytically corrodable washers made, for example, of magnesium alloy which corrodes rapidly in contact with steel, a suitable alloy being one consisting of 8.5% w/w of aluminium, 0.5% w/w zinc, 0.15% w/w manganese and 90.85% w/w magnesium. For more rapid destruction they are conveniently formed from polyvinyl alcohol or plasticised methyl cellulose composition as described in United Kingdom Patent Specification No. 703,962. A suitable composition consists of 53% w/w of methyl cellulose, 35% w/w propylene glycol and 10% w/w glycerine. On immersion of the casing of FIG. 2 filled with an explosive charge in sea water the casing remains intact for a period sufficient to enable the charge to be fired in normal practice but, when the washer 24 becomes weakened by corrosion or solution in the water the bolts 22 become slack and fall from the slots. Subsequent water surges quickly break the seal around the flanges to permit escape of the explosive charge.

In the modification shown in FIGS. 5–7 the flanges 13, 14 and 15 are clampled together by means of a grooved compression ring consisting of two half-ring sections 26 formed with grooves 27 gripping the peripheral edges of the flanges and forcing them into contact as the sections 26 are compressed. The ends of sections 26 are provided with lugs 28 formed with open ended slots 29 and the sections are bolted together by two diammetrically opposed bolts 30. The bolts 30 carry steel washers 31, sea-water-destructible washers 32 and tightening nuts 33. The washers 32 serve the same purpose and may conveniently be of the same composition as the washers 24 in FIG. 2 so that after a period of immersion of the casing in sea water the bolts 30 become slack and fall out of the slots 29 thereby permitting the clamping ring to separate from the casing with consequent disintegration of the casing.

What we claim is:

1. A casing for a sea-water-destructible shaped explosive charge comprising an explosives container element, a metal cavity liner element, adapted with the explosives container element to define a chamber for a shaped explosive charge, and a stand-off element adapted to define a stand-off volume for the shaped explosive charge, all three elements being bound together by a joint formed at the peripheral margin of each element, which joint comprises material which is destroyed by exposure to sea water whereby, on prolonged exposure of the casing to sea water, said material is destroyed and said elements are separated so as to permit the explosive contents of the shaped explosive to be dispersed in the sea water and rendered harmless.

2. A casing as claimed in claim 1 wherein the sea-water-destructible material comprises water-soluble polymeric material.

3. A casing as claimed in claim 2 wherein the water-soluble polymeric material is selected from the group consisting of polyvinyl alcohol and cellulose ether.

4. A casing as claimed in claim 3 wherein the water-soluble polymeric material comprises methyl cellulose.

5. A casing as claimed in claim 1 wherein the joint is a clamped joint and the sea-water-destructible material is used in a packing element of said joint.

6. A casing as claimed in claim 1 wherein the sea-water-destructible material comprises a binary metal system which undergoes electrolytic corrosion on exposure to sea water.

7. A casing as claimed in claim 6 wherein the binary metal system is selected from the group consisting of magnesium/iron, zinc/iron and tin/antimony systems.

8. A casing as claimed in claim 6 wherein the joint is a fused metal joint formed with a fused metal bonding medium and both metals of the binary system are included in said bonding medium.

9. A casing as claimed in claim 6 wherein a metal is used in the fabrication of the casing, the joint is a fused metal joint formed with a fused metal bonding medium and a complementary metal is provided in the said bonding medium, said complementary metal forming with the said casing metal an electrolytically corrodable binary metal system.

10. A casing as claimed in claim 6 wherein a metal is used in the fabrication of the casing, the joint is a clamped joint comprising a joint packing element and a complementary metal is provided in said packing element, said complementary metal forming with said casing metal an electrolytically corrodable binary metal system.

11. A casing as claimed in claim 1 wherein the said joint is a clamped joint the clamping pressure being applied by a clamp member adapted to separate from the shaped charge casing when the clamping pressure is relieved by the destruction of the sea-water-destructible material.

12. A casing as claimed in claim 11 wherein the clamp member comprises a bolt located in an open slot from which it is dislodged by sea water surges when the clamping pressure is relieved.

13. A casing for a sea-water-destructible shaped explosive charge comprising an explosives container element having a peripheral flange at one end, a metal cavity liner element having a peripheral flange at one end cooperating with the flange on the container element so that a chamber for a shaped explosive charge is defined between the container element and the liner element, and a stand-off element having a peripheral flange at one end cooperating with the flange on the liner element so that a stand-off volume for the shaped explosive charge is defined between the liner element and the stand-off element, all three elements being bound together by a releasable joint formed at the location of the flanges, the joint including material which in position in the joint maintains the joint tight, said material being exposed to sea water when the casing is immersed in sea water and being destroyed by exposure to sea water whereby, on prolonged exposure of the casing to sea water, said material is destroyed and said joint becomes loose so that said elements separate from each other to allow escape of the explosive charge from the container.

* * * * *